United States Patent [19]

Kramer et al.

[11] 4,266,762

[45] May 12, 1981

[54] SHEET ALIGNMENT AND FEEDING APPARATUS

[75] Inventors: William E. Kramer, Fairport; Frank P. Malinowski, Rochester, both of N.Y.

[73] Assignee: Xerox Corporation, Stamford, Conn.

[21] Appl. No.: 70,599

[22] Filed: Aug. 29, 1979

[51] Int. Cl.[3] ..... B65H 9/16; B65H 9/04

[52] U.S. Cl. ..... 271/225; 271/233; 271/236; 271/251; 271/186; 355/3 SH; 355/75

[58] Field of Search ..... 271/251, 250, 233, 275, 271/234, 236, 245–247, 3, 3.1, 4, 6, 7, 10, DIG. 9, 184, 186, 225; 355/3 SH, 14 SH, 75, 76

[56] References Cited

U.S. PATENT DOCUMENTS

| | | | |
|---|---|---|---|
| 2,124,855 | 7/1938 | Hitchcock | 271/251 |
| 3,510,125 | 5/1970 | Krueger et al. | 271/233 X |
| 3,908,986 | 9/1975 | Bleau | 271/251 X |
| 4,014,539 | 3/1977 | Goodwin | 271/251 X |
| 4,052,054 | 10/1977 | Cardwell et al. | 271/251 X |
| 4,104,105 | 8/1978 | Rayfield et al. | 271/251 X |
| 4,129,295 | 12/1978 | Hori et al. | 271/DIG. 9 X |

FOREIGN PATENT DOCUMENTS

| | | | |
|---|---|---|---|
| 689322 | 3/1953 | United Kingdom | 271/251 |

OTHER PUBLICATIONS

Fuller, D. D. in *Standard Handbook for Mechanical Engineers,* 7th Ed., ed. by T. Baumeister, N.Y., McGraw-Hill, 1967, pp. 3-34-3-37.

Lennon et al., "Sheet Positioning Apparatus", *IBM Technical Disclosure Bulletin,* vol. 17, No. 10, Mar. 1975, p. 2971.

*Primary Examiner*—Bruce H. Stoner, Jr.

[57] ABSTRACT

Sheet alignment and feeding apparatus including a sheet feed table for supporting a sheet to be fed, a side registration edge along one edge of the feed table, a sheet feed roll rotatably mounted in the feed table so that its top surface is in feeding engagement with a sheet to be fed, a cooperating pinch device in contact with the top of the feed roll, the feed roll being canted at an angle to the side registration edge to simultaneously drive a sheet against the registration edge and in a forward direction, and the feed roll having a relatively low coefficient of friction. The effects of contamination on the feed roll are minimized and a more effective and reliable feeding operation is achieved.

8 Claims, 4 Drawing Figures

SHEET ALIGNMENT AND FEEDING APPARATUS

CROSS REFERENCE TO RELATED APPLICATIONS

Reference is made to copending application of Rodney J. Jendrick Ser. No. 070,598 filed concurrently herewith entitled Sheet Feeding Apparatus; and to copending application of Donald J. Weikel, Jr. and John S. Bernhard Ser. No. 070,597, filed concurrently herewith entitled Reproducing Apparatus.

BACKGROUND OF THE INVENTION

This invention relates to sheet aligning and feeding apparatus and in particular to aligning one edge of a sheet against a registration edge while simultaneously feeding the sheet in a forward direction parallel to the registration edge.

This invention is particularly adapted for use with automatic reproduction apparatus for producing multiple copies of original documents. With the introduction of automatic reproduction machines, various devices have been used to feed documents or sheets to be copied onto the platen or copying surface of the reproduction machine.

Many devices for feeding documents rely on the operator manually accurately aligning one edge of the document against a registration edge with the document handler, then automatically transporting the document in a direction parallel to the registration edge while maintaining the document in contact with the edge.

Other devices have been used which do not rely on the operator to manually align one edge of the sheet but rather which permits the operator to more casually approximate the feeding orientation of a sheet being fed relative to a side registration edge. Still other devices have more affirmatively taken control of a document and automatically oriented the document along one edge while feeding in a second direction.

PRIOR ART STATEMENT

U.S. Pat. No. 2,124,855 describes a paper handling machine wherein a series of driven rollers cooperate with a series of rolling weights mounted above the rollers to feed sheets toward a side guide and at the same time, in a longitudinal direction. The driven rollers are mounted close to and canted with respect to the guide edge.

U.S. Pat. No. 3,908,986 discloses a sheet aligning mechanism wherein an eccentrically mounted continuously rotating feed roll is mounted in cooperative relation with a pinch device to thereby intermittently supply a driving force to the sheets being fed. The clearance between the pinch device and the eccentrically mounted feed roll is controlled so that the relatively thick and heavy weight sheets are continuously driven while the thinner lighter weight sheets are intermittently driven. I.B.M. Technical Disclosure Bulletin, Vol. 17, No. 10, Page 2971, March 1975 shows a similar device wherein a sheet is prealigned against two perpendicular registration surfaces. The device described in U.S. Pat. No. 3,908,986 is disclosed as an improvement over the prior approach of using a continuously rotating canted roller cooperating with a pinch device since such prior art devices cause wrinkling and buckling of light weight thin sheets.

Typically the known prior art feed rolls are made from natural or synthetic rubber or other elastomeric material. Frequently these feed rolls are made from a soft porous deformable material. These types of devices have relatively high coefficients of friction with the sheets being fed. U.S. Pat. No. 3,908,986 for example, describes the feed roll as being made from a material having a coefficient of friction of approximately 0.8. Several difficulties can be experienced with such feed rolls. Since the chief causes of friction are the interlocking of minute irregularities on the rubbing surfaces, the adhesion between the surfaces and the indentation of the softer body by the harder body the higher the coefficient of friction the greater the susceptability to contamination of the feed roll by dust, paper debris, and printing material such as toner. Such particles tend to adhere to the feed roll surface thereby contaminating it and reducing the coefficient of friction. With a reduced coeficient of friction and particularly with a dynamic relationship in which the coefficient of friction is being reduced, the feeding reliability will be adversely effected. In addition, as the contamination of the feed rolls increases the coefficient of friction is reduced and for a given system, the sheet feeding will be less positive and reliable. Furthermore, with the relatively abrasive rubber or elastomeric feed rolls surfaces, the contaminants including dirt, toner, and oil not only adhere to the roll surface but also may offset to paper thereby contaminating the paper. Further, and particularly, with the relatively soft or porous feed rolls after prolonged use, they may wear unevenly giving rise to change in coefficient of friction and thereby feeding reliability. They may also take on a partial deformity by setting during prolonged periods of idleness.

SUMMARY OF THE INVENTION

In accordance with this invention, a novel sheet alignment and feeding apparatus is provided. This apparatus has an improved feed roll and cooperating pinch device.

More particularly, the present invention is directed to sheet alignment and feeding apparatus including a sheet feed table, a side registration edge, a sheet feed roll rotatably mounted in the feed table and canted at an angle to the side registration edge, a cooperating pinch device in pressure contact with the top of the feed roll, the feed roll having a coefficient of friction of from about 0.15 to about 0.3 with the sheet being fed.

The present invention provides a device for simultaneously registering a sheet being fed along one edge while feeding it in a direction parallel to the registration edge.

The present invention also provides a sheet feeding device for a semiautomatic document handler. In particular it provides a document handler wherein the document may be aligned and fed in a forward direction around a direction reversing means and finally onto a document exposure platen by a belt transport.

Accordingly, it is an object of the present invention to provide a novel sheet alignment and feeding apparatus.

It is a further object of the invention to provide a consistently reliable sheet alignment and feeding device.

It is a further object of the invention to provide a sheet alignment and feeding device capable of feeding a wide range of light weight and heavy weight papers.

It is an additional object of the invention to provide a sheet alignment and feeding apparatus having reduced susceptability to the effects of feed roll contamination.

It is an additional object of the invention to provide a novel semiautomatic document handling apparatus.

For a better understanding of the invention as well as other objects and further features thereof reference is had to the following drawings and description.

DESCRIPTION OF PREFERRED EMBODIMENT

The invention will now be described by reference to a preferred embodiment of the sheet alignment and feeding apparatus.

Figure 1:
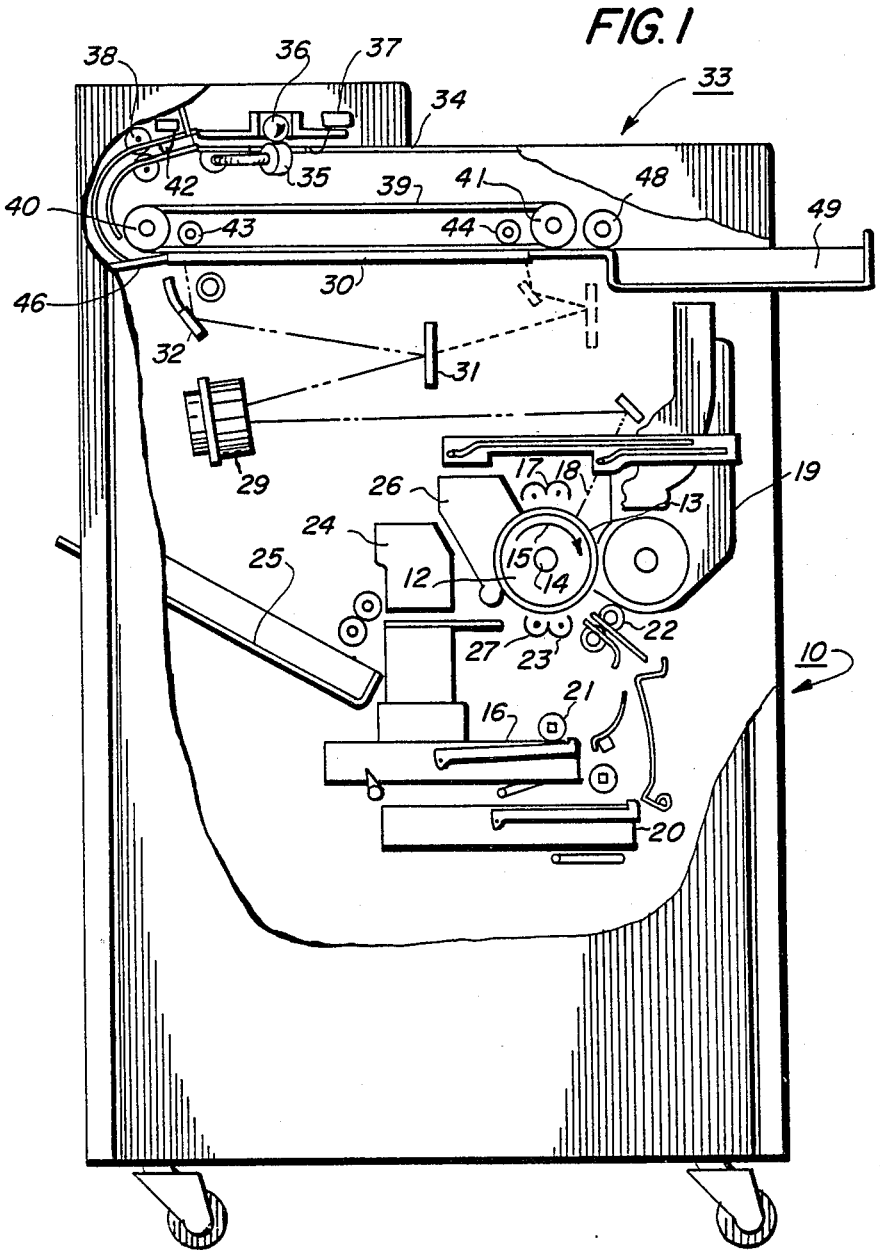
FIG. 1 is a schematic representation of an automatic xerographic reproducing apparatus employing the sheet alignment and feeding apparatus of the present invention.

Referring now to FIG. 1, there is shown by way of example an automatic xerographic reproducing machine 10 which includes the sheet alignment and feeding means of the present invention. The reproducing machine 10 depicted in FIG. 1 illustrates the various components utilized therein for producing copies from an original document. Although the apparatus of the present invention is particularly well adapted for use in an automatic xerographic reproducing machine 10, it should become evident from the following description that it is equally well suited for use in a wide variety of processing systems including other electrostatographic systems and it is not necessarily limited in the application to the particular embodiment or embodiments shown herein.

The reproducing machine 10, illustrated in FIG. 1 employs an image recording drum-like member 12, the outer periphery of which is coated with a suitable photoconductive material 13. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

The practice of xerography is well known in the art and is the subject of numerous patents and texts including *Electrophotography* by Schaffert, and *Xerography and Related processes* by Dessauer and Clark, both published in 1965 by the Focal Press.

Initially, the drum 12 moves the photoconductive surface 13 through a charging station 17 where an electrostatic charge is placed uniformly over the photoconductive surface 13 in known manner preparatory to imaging. Thereafter, the drum 12 is rotated to exposure station 18 wherein the charged photoconductive surface 13 is exposed to a light image of the original input scene information whereby the charge is selectively dissipated in the light exposed regions to record the original input scene in the form of an electrostatic latent image. After exposure, drum 12 rotates the electrostatic latent image recorded on the photoconductive surface 13 to development station 19 wherein a conventional developer mix is applied to the photoconductive surface 13 of the drum 12 rendering the latent image visible. Typically a suitable development station could include a magnetic brush development system utilizing a magnetizable developer mix having coarse ferromagnetic carrier granules and toner colorant particles.

Sheets 16 of the final support material are supported in a stack arrangement on an elevating stack support tray 20. With the stack at its elevated position a sheet separator 21 feeds individual sheets therefrom to the registration system 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16. Following transfer of the image the final support material which may be paper, plastic, etc., as desired, is transported through detack station where detack corotron 27 uniformily charges the support material to separate it from the drum.

After the toner image has been transferred to the sheet of final support material 16 the sheet with the image thereon is advanced to a suitable fuser 24 which coalesces the transferred powder image thereto. After the fuser process the sheet 16 is advanced to a suitable output device such as tray 25.

Although a preponderance of toner powder is transferred to the final support material 16, invariably some residual toner remains on the photoconductive surface 13 after the transfer of the toner powder image to the final support material. The residual toner particles remaining on the photoconductive surface 13 after the transfer operation are removed from the drum 12 as it moves through a cleaning station 26. The toner particles may be mechanically cleaned from the photoconductive surface 13 by any conventional means as, for example, by the use of a cleaning blade.

Normally, when the copier is operated in a conventional mode, the original document to be reproduced is placed image side down upon a horizontal transparent viewing platen 30 and the stationary original then scanned by means of a moving optical system. The scanning system fundamentally consists of a stationary lens system 29 positioned below the right hand margin of the platen as viewed in FIG. 1 and a pair of cooperating movable scanning mirrors 31, 32 which are carried upon carriages not illustrated. For further description and greater details concerning this type of optical scanning system reference is had to U.S. Pat. No. 3,832,057 to Shogren.

The illustrated apparatus is also provided with a document handler 33 which includes an input station, a copying sheet receiving slot 34, sheet alignment and feeding apparatus of the present invention including feed roll 35 and cooperating pinch device 36 as will be more fully discussed later. When a sheet is inserted it makes switch 37 which activates sheet alignment roll 35 which feeds the sheet forward and aligns it against the rear edge guide of the document handler. The pinch rolls 38 are activated when switch 42 is made to feed a document around the 180° curved guides onto the platen 30. The platen belt transport is comprised of a single wide belt 39 having one run over the platen 30.

The belt 39 is wrapped about two pulleys 40 and 41 which are arranged such that the belt surface at the bottom of the pulley with the assistance of input backup roll 43 and output backup roll 44 is in light contact with the platen. The document is driven by the belt 39 across the platen until the trailing edge of the document has cleared registration edge 46 after which the platen belt transport is stopped and the direction in which the document is driven is reversed so that it is registered against registration edge 46 and is now ready for copying. Once in position, the scanning optical system is activated and the document is scanned by full rate mirror 32. At the end of scan the full rate mirror 32 and the half rate mirror 31 are in the positions shown in phantom in FIG. 1. After copying the platen belt transport is again activated and the document is driven off the platen by the output pinch roll 48 into the document catch tray 49.

It is believed that the foregoing general description is sufficient for purposes of the present application to illustrate the general operation of an automatic xerographic copier 10 which can embody the apparatus in accordance with the present invention.

Figure 2:
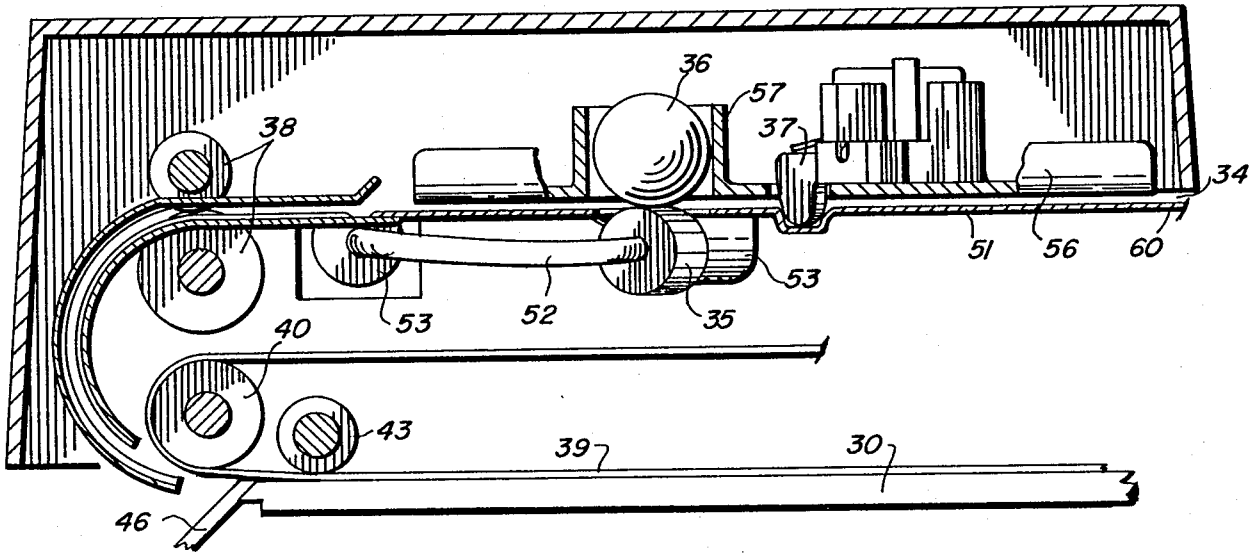
FIG. 2 is a side view of the sheet alignment and feeding apparatus of the present invention.
Figure 3:
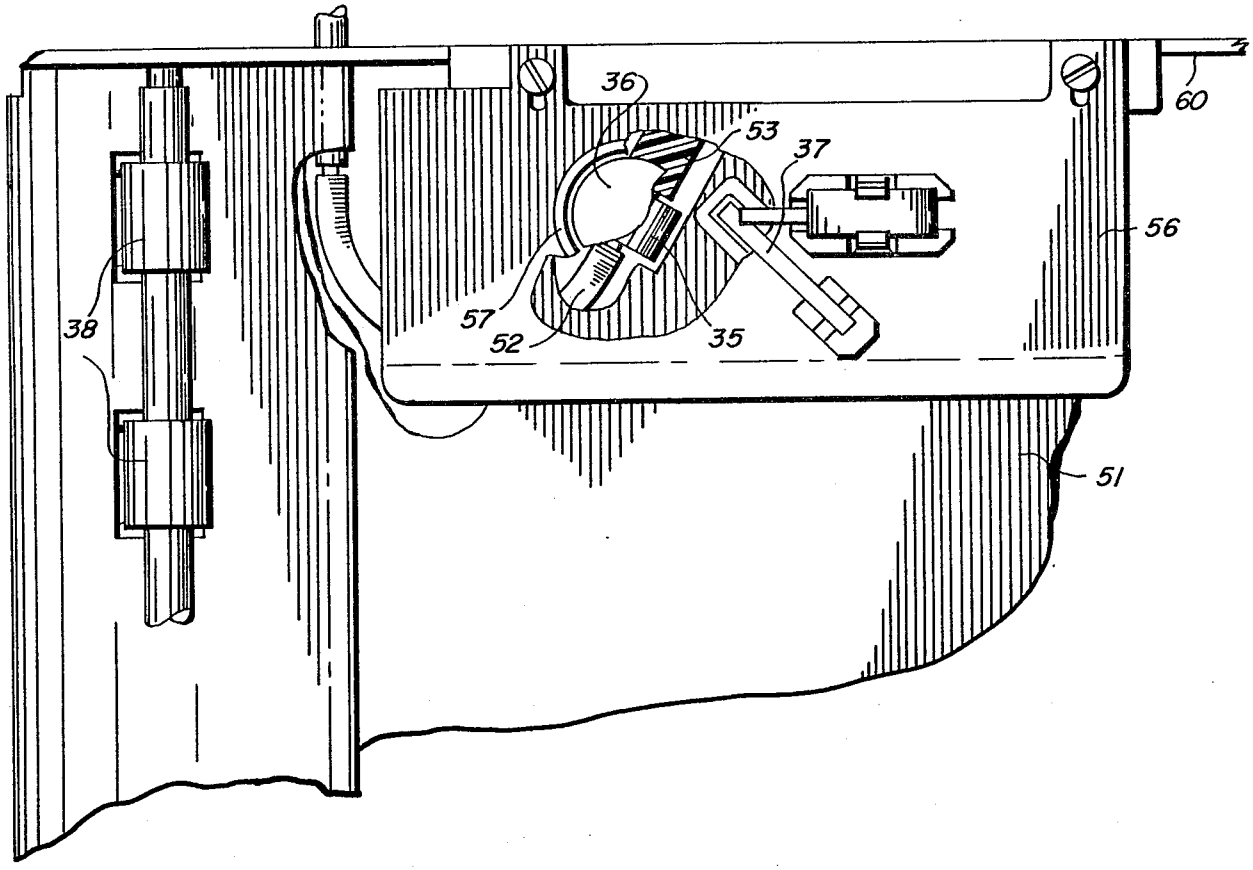
FIG. 3 is a top view with a portion cut away of the sheet alignment and feeding apparatus of the present invention.
Figure 4:
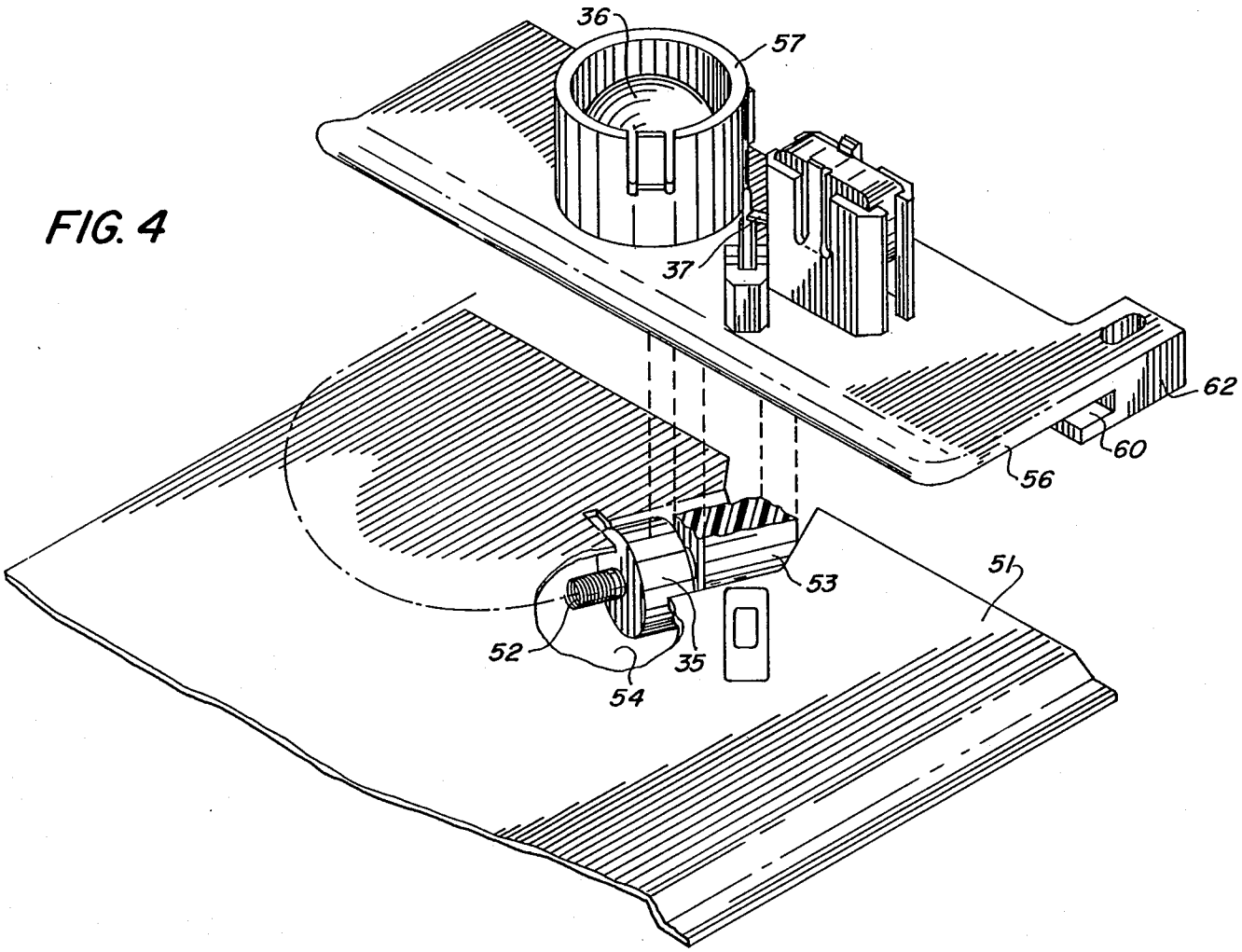
FIG. 4 is an exploded isometric view of the document feeding apparatus showing the sheet alignment and feeding apparatus of the present invention.

Referring more particularly to FIGS. 2 to 4 wherein the sheet alignment and feeding apparatus of the present invention is described in greater detail, copying sheet receiving slot 34 is defined by the sheet feed table 51 and upper baffle 56. A sheet may be manually placed within this slot to initiate contact with the feed roll and subsequent sheet alignment and feeding. The feed roll 35 is fixedly mounted within roll supports 53 at either end and within a depression 54 in sheet feed table 51 so that the top of the sheet feed roll is in the supporting plane for feeding sheets. The feed roll is fixedly attached to and rotatably driven in a sheet feeding direction through feed roll drive shaft 52 from some external drive source (not shown). Cooperating with the feed roll is the pinch device 36 illustrated as a spherical ball in FIGS. 2–4 which is mounted freely and idly in ball retainer 57 which is located in part of the upper baffle 56. The upper baffle 56 is mounted to side frame 62 as is the sheet feed table 51, thereby maintaining a uniform sheet receiving slot 34.

The side registration edge 60 is mounted along one edge of the sheet feed table to provide a long strip along which one edge of the sheet may be registered. The sheet feed roll 35 is positioned to be canted toward the side registration edge 60 so that a portion of the drive force acts to drive the sheet toward the side registration edge while a portion of the drive force acts to drive the sheet forward in a sheet feeding direction parallel to the side registration edge. The feed roll 35 may be positioned at any suitable position relative to the side registration edge and the next operating station in the feeding direction. Typically the feed roll 35 is canted at an angle of from about 25 degrees to about 35 degrees with respect to the side registration edge. Good balance between registering the sheet being fed along the side registration edge and forwarded in a sheet feeding direction is achieved with the feed roll 35 canted at an angle of about 30° toward the side registration edge.

Typically it is positioned in such manner to completely align one edge of the sheet being feed along the side registration edge prior to the leading feeding edge arriving at the next operating station. This may typically involve the placement of the feed roll from about one half inch to about two inches from the side registration edge and from about two inches to about five inches from the next operating station. With this type of orientation sheets to be fed may be manually presented to the alignment and feeding mechanism in a very rough approximation of the final orientation.

With the feed roll having a relatively low coefficient of friction with the sheets being fed, the influence of contamination and the possibility of contamination are substantially reduced. The window of reliable effective sheet feeding is broader than those of the prior art devices. This is because the contamination of the feed roll by dust, paper debris and toner has a much reduced effect with a feed roll having a low coefficient of friction compared to the prior art devices. In the prior art devices having a relatively high coefficient of friction, the operability window is dramatically influenced by contamination. For example, a clean feed roll having an initial coefficient of friction of 0.8 may have this value substantially reduced to about 0.5 by the effects of contamination whereas a clean feed roll having an initial relatively low coefficient of friction of about 0.25 will have its coefficient of friction reduced to about 0.20 by contamination.

Since in any sheet alignment and feeding mechanism the frictional force is a function of the coefficient of friction times the normal force for any given normal force there will be greater variability of the frictional force with a feed roll having a high coefficient of friction since it is the type of roll that is most dramatically influenced by contaminants. Therefore by selecting a relatively large normal force as produced by the weight off the idler ball 36 against the feed roll and by selecting the feed roll to be of relatively low coefficient of friction a sheet alignment and feeding system with a large operability window relatively uninfluenced by the effects of contamination is obtained.

A feed roll having a coefficient of friction with the paper being fed of from about 0.15 to about 0.3 is particularly effective in maintaining a large operability window minimized by the effects of contamination. With such a feed roll, the pinch device or idler ball may be of any suitable weight. Typically it provides a relatively high normal force compared to the prior art techniques employing relatively high coefficients of friction. Typically the normal force is sufficient to provide a low forward sheet driving force with the feed roll having the above specified coefficient of friction. Pinch devices yielding normal forces within the range of from about 0.10 pounds to about 0.20 pounds are particularly satisfactory for these feed rolls. With feed roll coefficients of friction less than about 0.15 the slipping between the feed roll and paper is so excessive that the feeding becomes unreliable. With feed roll coefficients of friction greater than about 0.3 the system tends to possess too much overdrive which may result in damage to some of the sheets particularly the very light weight flexible documents. While feed rolls having coefficients of friction over the range of from about 0.15 to about 0.3 produce reliable and effective results, a coeffient of friction of about 0.2 is preferred in maximizing feeding reliability. A particular advantage of the present system is that with a relatively low driving force potential damage to light weight documents is minimized.

The feed rolls and pinch devices or idler ball may be made from any suitable material. Typically they are made from hard materials and the rolls have relatively smooth surface finishes. Feed rolls made from steel, brass, glass, aluminum and some plastics having the above coefficient of friction are particularly suitable.

When speaking of the coefficient of friction it is intended to define the relationship between the feed roll and the paper being fed. While this is basically a fixed relationship it may to some extent, vary depending on the environmental temperatures and humidity. Some variation may also be experienced due to the differences in surfaces of the sheets being fed. The range of the coefficient of friction of from about 0.15 to about 0.3 encompases the operative range for conditions of humidity temperature and sheet surface conditions normally encountered in a copying environment. Typically the relative humidity is of the order from about 10% to about 85% while the temperature is in the range of from about 60° F. to about 90° F. Under these conditions the sheet alignment and feeding apparatus of this invention is capable of aligning and feeding paper sheets from 9 pound onion skin to 110 pound card stock.

In operation, a sheet of paper or document is manually inserted in the sheet receiving slot 34 into the nip between the feed roll 35 and the idler ball 36. The feed roll which may for example be a one inch diameter steel roll is driven rapidly at about 600 rpm and with a steel idler ball creating a normal force of about 0.15 pounds by virtue of its weight the sheet is fed forward in two directions at the same time to align one edge against the side registration edge and to feed the leading edge to the next processing station. With the sheet moving forward, the idler ball rotates freely within its retainer while maintaining the normal force to insure continued sheet feeding. Once the side edge of the sheet is aligned against the side registration edge the sheet alignment apparatus continues to feed the sheet in a forward direction to the next processing station while maintaining the side edge aligned to the side registration member. Typically the device is capable of accommodating papers from 9 pound onion skin to 110 pound card stock. To accommodate the heavier, thicker papers, the throat between the fixed feed roll and the movable idler ball has a maximum throat dimension of about $\frac{1}{8}$ inch. It should be noted that with such a device if one begins to insert a sheet to be aligned and fed and wishes to change his mind, he may withdraw the sheet merely by pulling on the trailing edge of the sheet until it is withdrawn from the nip between the feed roll and the idler ball.

The patents and texts referred to specifically in this application are intended to be incorporated by reference into this application.

In accordance with the invention a sheet alignment and feeding apparatus is provided. This enables more effective and reliable sheet alignment and feeding than similar devices by virtue of having reduced effect of contaminates in the sheet feeding operation. While this invention has been described with reference to the specific embodiments described, it will be apparent to those skilled in the art that many alternatives, modifications or variations may be made by those skilled in the art. For example, while the invention has been described with reference to a xerographic reproducing apparatus, it should be noted that it is applicable to many sheets feeding configurations. Accordingly, it is intended to embrace all such alternatives and modifications as may fall within the spirit and scope of the appended claims.

What is claimed is:

1. Document copying apparatus comprising:

a document exposure platen for viewing a document to be copied;

a sheet feed table defining a plane for supporting a sheet to be fed in a sheet feeding direction;

a side registration edge substantially parallel to the sheet feeding direction;

a sheet feed roll rotatably mounted in said feed table such that its top surface is in the supporting plane for feeding a sheet, a cooperating pinch device in contact with the top of said feed roll, said feed roll being canted at an angle to the side registration edge to simultaneously drive a sheet against the side registration edge and in a forward sheet feeding direction, said feed roll having a coefficient of friction of from about 0.15 to about 0.30, sheet take away and transport means adjacent the output end of said sheet feed table and into which said sheet feed roll feeds a sheet, arcuate sheet direction reversing means adjacent said sheet take away and transport means to receive a sheet therefrom, said direction reversing means having an exit portion adjacent said document exposure platen, and means to transport a sheet from the exit portion of said direction reversing means onto said document exposure platen.

2. The apparatus of claim 1 wherein said sheet transport comprises a single wide document transport belt movably mounted about support rolls at opposite ends of the document exposure platen.

3. The apparatus of claim 2 wherein said document exposure platen comprises an exposure platen with a sheet registration member on one edge adjacent the sheet input side of the document transport belt and further including means to drive said document transport belt in a forward direction across said platen until the trailing edge of a sheet being fed is fed past said sheet registration member, document transport belt direction reversing means to drive said document transport belt in a reverse direction to transport a sheet being fed in a reverse direction into registration against said registration member to position said sheet for exposure and means to activate the document transport belt to transport said sheet in a forward direction when exposure of said sheet is completed.

4. The sheet feeding apparatus of claim 1 wherein said coefficient of friction is about 0.2.

5. The sheet feeding apparatus of claim 1 wherein said sheet feed roll comprises a rotatably driven cylindrical steel roll.

6. The sheet feeding apparatus of claim 1 wherein said sheet feed roll is canted at an angle of from about 25 degrees to about 35 degrees to the side registration edge.

7. The sheet feeding apparatus of claim 1 wherein said pinch device comprises a spherical idler ball in pressure contact by virtue of its weight with the feed roll and movable in a direction perpendicular to a sheet feeding direction to accommodate the feeding of sheets of different sizes between the driven cylindrical roll and the idler ball.

8. The sheet feeding apparatus of claim 1 wherein said pinch device provides a normal force of from about 0.1 pound to about 0.2 pound on said sheet feed roll.

* * * * *